US005095815A

United States Patent [19]

Baumgartner

[11] Patent Number: 5,095,815

[45] Date of Patent: Mar. 17, 1992

[54] SCRAPING DEVICE FOR CAN CRUSHING APPARATUS

[75] Inventor: Mark B. Baumgartner, Jamestown, N. Dak.

[73] Assignee: Haybuster Manufacturing Inc., Jamestown, N. Dak.

[21] Appl. No.: 628,605

[22] Filed: Dec. 17, 1990

[51] Int. Cl.[5] ..... B30B 3/06; B30B 9/32

[52] U.S. Cl. ..... 100/174; 100/157; 100/902; 241/228

[58] Field of Search ..... 100/174, 902, 157; 241/228

[56] References Cited

U.S. PATENT DOCUMENTS

| | | | |
|---|---|---|---|
| 363,827 | 5/1887 | Hinsdale | 100/174 X |
| 1,249,852 | 12/1917 | Symons | 241/228 X |
| 2,229,143 | 1/1941 | Stacom | 100/157 |
| 2,306,655 | 12/1942 | Traux | 100/157 X |
| 2,682,832 | 7/1954 | Lohre et al. | 100/157 X |
| 2,698,144 | 12/1954 | Reiffen | 241/228 X |
| 4,313,375 | 2/1982 | Saalasti | 100/157 X |
| 4,355,573 | 10/1982 | Berry | 100/157 X |
| 4,444,100 | 4/1984 | Newman | 100/157 |
| 4,573,405 | 3/1986 | Morlock | 100/157 |

*Primary Examiner*—Harvey C. Hornsby
*Assistant Examiner*—Stephen F. Gerrity
*Attorney, Agent, or Firm*—Kinney & Lange

[57] ABSTRACT

A device is provided for releasing cans clinging to an outer wall surface of a crushing roller and/or an inner wall surface of a tubular drum in a can crushing apparatus. To remove cans adhered to the roller, a scraping mechanism is adjustably mounted on a support arm of the can crushing apparatus. To remove cans from the inner wall surface of the tubular drum, a second scraping mechanism is adjustably mounted on a support of the can crushing apparatus.

3 Claims, 2 Drawing Sheets

SCRAPING DEVICE FOR CAN CRUSHING APPARATUS

BACKGROUND OF THE INVENTION

The present invention relates to rotary drum can crushers and, in particular, it relates to a scraping device for scraping crushed cans off the drums of rotary drum can crushers.

Rotary drum can crushers for crushing metal cans to facilitate the recycling and eventual reuse of cans are known. However, none of the can crushers to date provide a scraping mechanism for removing crushed cans which tend to cling to the rotary drums of the crushers subsequent to the can being crushed.

For example, the Newman U.S. Pat. No. 4,444,100 describes a can crusher having an outer drum and a roller within the drum. The outer drum has a drive ring around its outer periphery, and the inner drum or roller is an idler. Cans are introduced into the crusher and directed to a nip between the outer drum and the roller.

The Morlock U.S. Pat. No. 4,573,405 describes a can crushing apparatus having an outer, bottomless drum housing, which is tubular and mounted on rollers to be freely rotatable. A driven central inner roller mounted on the interior of the tubular drum is urged against one side of the drum. Cans to be crushed are guided into a nip between the roller and the outer drum, and are crushed as they pass between the roller and drum under spring load.

The can crushers of the above references occasionally will have crushed cans that cling to the crushing surfaces of the drum and/or the roller. In order to remove the clinging cans, the can crusher must be stopped and the cans manually removed. Stopping the machine every time a can needs to be removed is very time consuming.

SUMMARY OF THE INVENTION

A scraper is provided for removing cans from crushing surfaces of a can crusher. The can crusher has an open topped, tubular drum having an annular inner wall surface. The drum is rotatably mounted on a support. A roller having an outer surface is mounted on the interior of the drum. The roller is spring loaded to move its outer surface into engagement with the inner wall surface of the drum. A drive motor is mounted to be movable with and is used to drive the roller to thereby crush cans introduced into the tubular drum between the roller means and inner wall surface of the tubular drum.

A first scraper runs adjacent the outer surface of the roller for releasing cans clinging to the outer surface. A second scraper is provided adjacent the inner wall surface of the drum for releasing cans clinging to the inner wall surface. The scrapers are adjustably mounted on their respective supports.

DETAILED DESCRIPTION OF THE PREFERRED EMBODIMENTS

Figure 1:
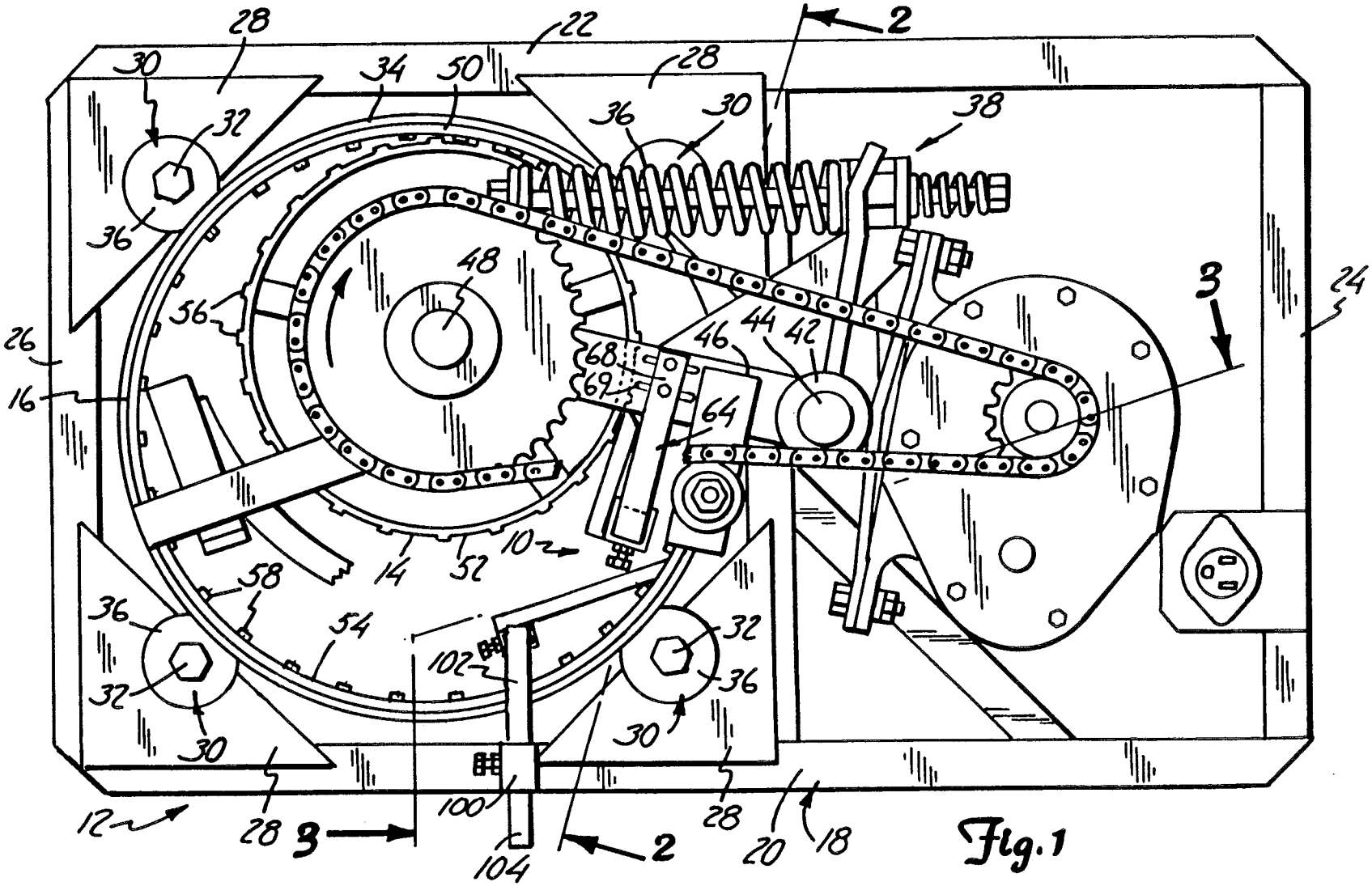
FIG. 1 is a top plan view of a can crushing apparatus with scrapers made according to the present invention installed thereon.

A can crushing apparatus indicated at 12 is provided with scraper or scraping device 10 and 92. The scraping devices are used to remove cans (not shown) which tend to cling to the interior of can crushing apparatus 12.

The particular can crushing apparatus 12 illustrated in the drawings shows a typical rotary drum can crusher with a crushing roller 14 and a tubular drum 16, as disclosed in U.S. Pat. No. 4,573,405. Although a specific type of can crushing apparatus 12 is illustrated, the scrapers of the present invention can be used with almost any rotary drum can crushing apparatus.

The can crushing apparatus 12 includes a frame 18. The frame 18 includes a pair of substantially parallel side rails 20 and 22 and a pair of substantially parallel end rails 24 and 36 with the side rails 20 and 22 being of substantially equal length and the end rails 24 and 26 being of substantially equal length. The side rails 20 and 22 are joined to the end rails 24 and 26 of the frame 18 by suitable welding or other conventional means.

The frame 18 has a plurality of gusset support plates (four of them as shown) indicated generally at 28 thereon that in turn rotatably support bearings indicated at 30 using suitable cap screws 32 to hold the bearings 30 in place. The bearings 30 are rotatably mounted about generally vertical parallel axes.

The tubular drum 16, as shown, fits between the gussets 28, and has an annular rib 34 positioned around the tubular drum 16 about midway along its length. The annular rib 34 rests on upper edges or surfaces 36 of the bearings 30, so that the tubular drum 16 is supported in position for rotation as guided by the bearings 30 about a vertical axis, parallel to the axes of rotation of the bearings 30. In FIG. 1, it can be seen that the tubular drum 16 is positioned in an opening defined by the gussets or supports 28 within the frame 18.

The crushing apparatus 12 further comprises an assembly 38 that includes a drive motor and the crushing roller 14. This assembly 38 comprises a main support hub 42 that is rotatably mounted or pivotally mounted on a shaft 44 which in turn is welded to a suitable support plate on the frame 18, and extends uprightly therefrom. The support hub 42 has a main support arm 46 fixed thereto which extends laterally from the support hub 42, and is positioned above an upper edge 50 of the tubular drum 16. Thus, the weight of the crushing roller 14 is supported on the support arm 46, through the support hub 42.

The drive motor is mounted to be movable with the support arm 46 about the axis for driving the crushing roller 14. The drive motor drives the crushing roller 14 such that cans are crushed after being introduced into the tubular drum 16 between an outer wall surface 52 of the crushing roller 14 and an inner wall surface 54 of the tubular drum 16. The cans are crushed in a crushing region where the outer wall surface 52 of the crushing roller 14 and the inner wall surface 54 of the tubular drum 16 are adjacent or contiguous.

Figure 2:
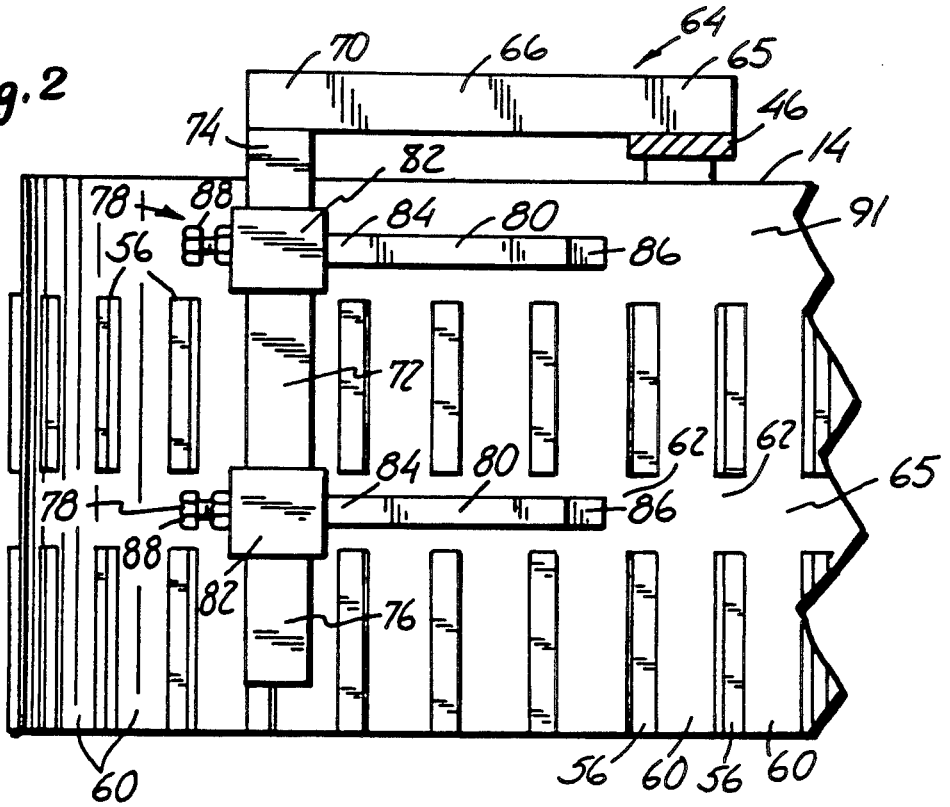
FIG. 2 is a sectional view taken as on line 2—2 in FIG. 1.

As illustrated in FIG. 2, the outer wall surface 52 of the crushing roller 14 preferably has a plurality of annularly spaced ribs 56 thereon with grooves 60 between each of the spaced ribs 56. In addition, each of the ribs 56 is formed in two sections with a space or gap 62. Each gap 62 is aligned with the gaps 62 of the other ribs to form an annular or peripheral track 65 around the crushing roller 14. The upper ends of the ribs 56 also terminate short of the upper edges of the crushing roller 14 to form an annular track 91 on the outer wall surface 52 of the crushing roller 14.

The inner wall surface 54 of the tubular drum 16 preferably has a plurality of annularly spaced ribs 58 thereon with grooves 63 between each of the spaced ribs 58. These ribs 58 are also in two sections and form a gap 69. The gaps 69 of the ribs align around the entire inner wall surface 54 of the tubular drum 16 thereby forming an annular internal track 67.

The ribs 56 and 58 interfit when the crushing apparatus 12 is empty and tend to grip the cans to be crushed. The cans are held tightly so the cans will be driven into the crushing region between the crushing roller 14 and the tubular drum 16. As illustrated in FIG. 1, the crushing roller 14 axis of rotation, which is the axis of the shaft 48, is offset from the axis of tubular drum 16 such that the grooves 60 on the outer wall surface 52 of the crushing roller 16 receive the ribs 58 on the inner wall surface 54 of the tubular drum 16. In addition, the grooves 63 on the inner wall surface 54 of the tubular drum 16 receive the ribs 56 on the outer wall surface 52 of the crushing roller 14.

As shown in FIG. 2, crushing roller scraper or scraping means 64 are provided for releasing cans clinging to the outer wall surface 52 of the crushing roller 14 after exiting the crushing region. The crushing roller scraping means 64 include a support arm mounting arm 66 having a first end portion 68 and a second end portion 70. The first end portion 68 of the support arm mounting arm 66 is securely connected to the support arm 46 by bolts or cap screws passing through adjustment slots 69 in support arm 46 or by other conventional adjustable means.

A crushing roller scraper arm 72 is provided having a first arm end portion 74 and a second arm end portion 76. The first arm end portion 74 is securely fastened to the second end portion 70 of the support arm mounting arm 66. The first arm end portion 74 is preferably connected to the support arm mounting arm 66 by welding or other conventional means.

First removal means 78 for releasing cans tending to cling to the crushing roller 14 are adjustably mounted to the crushing roller scraping arm 72. The first removal means 78 includes a plurality of first scraper blades 80 and attached collars 82. Each of the first scraper blades 80 has a first blade end 84 and a second blade end 86. The first blade end 84 is securely fastened to the collar 82 by welding or other conventional means. The collar 82 is designed and shaped to pass around the crushing roller scraping arm 72 such that the first scraper blades are adjustable along the entire length of the crushing roller scraping arm 72.

A separate tightening screw 88 threads through an aperture 90 in each collar 82 and is provided to clamp or secure the respective scraper blade 80 to the crushing roller scraping arm 72.

Each of the first scraper blades 80 extends from the crushing roller scraping arm 72 toward the crushing roller 14 to a point adjacent the outer wall surface 52 of the crushing roller 14. In addition, the first scraper blades 80 can be adjusted toward and away from the crushing roller 14 using slots 69 such that each of the first scraper blades 80 are close to the outer wall surface 52 of the crushing roller 14. The first scraper blades 80 are preferably axially spaced such that at least one first blade 80 follows the corresponding track 65 and at least one first blade 80 follows an upper track 91 on the outer surface 52 of the crushing roller 14 above the ribs 56.

Figure 3:
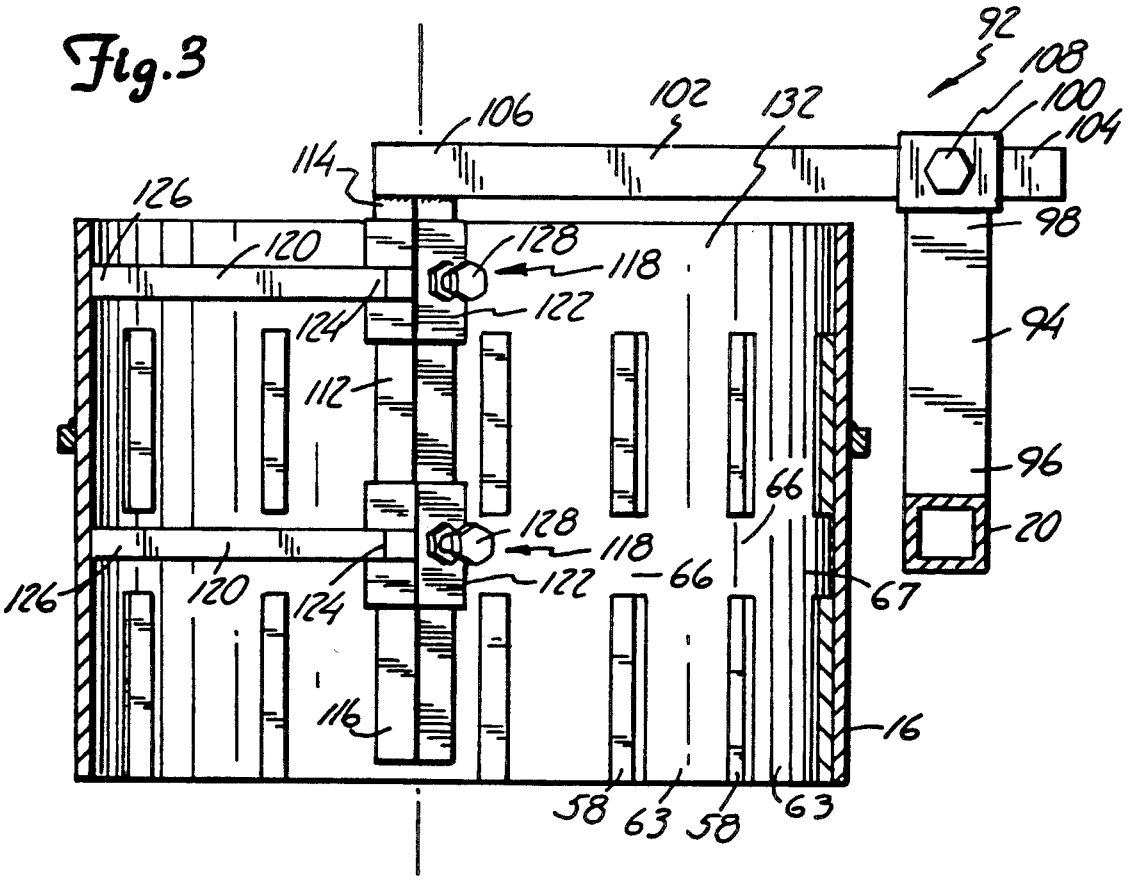
FIG. 3 is a sectional view taken as on line 3—3 in FIG. 1.

As shown in FIG. 3, tubular drum scraping means 92 are provided for releasing cans clinging to the inner wall surface 54 of the tubular drum 16 after exiting the crushing region. The tubular drum scraping means 92 includes a tubular drum arm 94 having a first end portion 96 and a second end portion 98. The first end portion 96 of the tubular drum arm 94 is securely connected to the side rail 20 by conventional means. The tubular drum arm 94 is substantially perpendicular to the side rail 20 and extends upwardly to a point above the upper edge 50 of the tubular drum 16.

A tubular drum collar 100 is securely connected to the second end portion 98 of the tubular drum arm 94 and is designed and shaped to receive a tubular drum scraper mount 102 having a first end portion 104 and a second end portion 106. The first end portion 104 of the tubular drum scraper mount 102 is slidably mounted in the tubular drum collar 100 and held in an adjusted position with a set screw 108 threaded through one wall of collar 100.

A tubular drum scraper arm 112 having a first arm end portion 114 and a second arm end portion 116 is securely fastened to the second end portion 106 of the tubular drum scraper mount 102. The first arm end portion 114 is preferably connected to the tubular drum scraper mount 102 by welding or other conventional means.

Second removal means 118 for releasing cans tending to cling to the tubular drum 18 are adjustably mounted on the tubular drum scraping arm 112. The second removal means 118 includes a plurality of second scraper blades 120 and collars 122. Each of the second scraper blades 120 has a first blade end portion 124 and a second blade end portion 126. The first blade end portion 124 is securely fastened to the collar 122 by welding or other conventional means. The collar 122 is designed and shaped to pass around the tubular drum scraping arm 112 such that the second removal means 118 is adjustable along the length of the tubular drum scraping arm 112.

A tightening screw 128 screws into a threaded aperture in the collar 122 and is provided to bear against and clamp or secure the second scraping means 118 to the tubular drum scraping arm 112.

Each of the second scraper blades 120 extends from the tubular drum scraping arm 112 toward the tubular drum 16 to a point adjacent the outer wall surface 54 of the tubular drum 16. In addition, each of the second scraper blades 120 can be adjusted in relation to the tubular drum scraper arm 112 using collar 100 and set screw 108 such that the second end portion 126 of each of the second scraper blades 120 are positioned close to the inner wall surface 54 of the tubular drum 16. The second scraper blades 120 are preferably spaced such that at least one second blade 120 follows the corresponding track 67 and at least one second blade 120 follows an upper track portion 132 on the inner surface 54 of the tubular drum 16. The track portion 132 is formed by terminating the ribs 58 below the upper edge of the drum 16.

The cans will be deformed around the ribs of both the roller and drum as the roller is powered. The crushed cans normally will be dropped through an opening in the bottom of the drum, but if cans stick to the crushing surfaces, they can cause jamming if the cans are carried around to the crushing region again. The scraper blades are within the grooves so cans formed over ribs and jammed in place will be lifted off the rollers or drum after exiting the crushing region and then will be free to drop out of the drum.

Although the present invention has been described with reference to preferred embodiments, workers skilled in the art will recognize that changes may be made in form and detail without departing from the spirit and scope of the invention.

What is claimed is:

1. A device for releasing cans from a can crushing apparatus that includes a support, tubular drum means having an inner wall surface and being rotatably mounted on the support, roller means having an outer wall surface, mounting means to mount the roller means on the interior of the tubular drum means with its outer wall surface urged toward and adjacent the inner wall surface of the tubular drum means to form a can crushing region and a drive motor mounted to be movable with a support arm about the axis for driving the roller means to crush cans introduced into the tubular drum means between the outer wall of the roller means and the inner wall surface of the tubular drum means in the crushing region, the device comprising:

scraping means adjacent at least one of the wall surfaces positioned to release cans from such one wall surface after crushing the can;

wherein the scraping means includes at least one scraping blade, the scraping blade having a scraping end, means for adjustably coupling the scraping blade to the support arm whereby the scraping blade is adjustable relative to the support arm such that the scraping end of the scraping blade is positioned adjacent to the outer wall surface of the roller means; and wherein the outer wall surface of the roller means has raised ribs for gripping a can to be crushed, each rib including a first section and a second section with a first gap separating the first and the second sections thereby forming a first track such that the scraping end of the scraping blade remains adjacent to the outer wall surface of the roller means with the scraping end of the scraping blade following in the first track.

2. A device for releasing cans from a can crushing apparatus that includes a support, tubular drum means having an inner wall surface and being rotatably mounted on the support, roller means having an outer wall surface, mounting means to mount the roller means on the interior of the tubular drum means with its outer wall surface urged toward and adjacent the inner wall surface of the tubular drum means to form a can crushing region and a drive motor mounted to be movable with a support arm about the axis for driving the roller means to crush cans introduced into the tubular drum means between the outer wall of the roller means and the inner wall surface of the tubular drum means in the crushing region, the device comprising:

scraping means adjacent at least one of the wall surfaces positioned to release cans from such one wall surface after crushing the can;

wherein the scraping means includes at least one scraping blade, the scraping blade having a scraping end, means for adjustably coupling the scraping blade to the support whereby the scraping blade is adjustable relative to the support such that the scraping end of the scraping blade is positioned adjacent to the inner wall surface of the tubular drum means; and wherein the inner wall surface of the tubular drum means has raised ribs for gripping a can to be crushed, each rib including a third section and a fourth section with a second gap separating the third and the fourth sections thereby forming a third track such that the scraping end of the scraping blade remains adjacent to the inner wall surface of the tubular drum means with the scraping end of the scraping blade following in the third track.

3. A device for releasing cans from a can crushing apparatus that includes a support, tubular drum means having an inner wall surface and being rotatably mounted on the support, roller means having an outer wall surface, mounting means to mount the roller means on the interior of the tubular drum means with its outer wall surface urged toward and adjacent the inner wall surface of the tubular drum means to form a can crushing region and a drive motor mounted to be movable with a support arm about the axis for driving the roller means to crush cans introduced into the tubular drum means between the outer wall of the roller means and the inner wall surface of the tubular drum means in the crushing region, the device comprising:

first scraping means adjacent the outer wall surface of the roller means positioned to release cans after crushing the cans;

second scraping means adjacent the inner wall surface of the tubular drum means positioned to release cans after crushing the cans;

wherein the first scraping means includes at least one first scraping blade, the first scraping blade having a scraping end, first coupling means for adjustably coupling the first scraping blade to the support arm whereby the first scraping blade is adjustable relative to the support arm such that the scraping end of the first scraping blade is adjacent the outer wall surface of the roller means;

wherein the second scraping means includes at least one second scraping blade, the second scraping blade having a scraping end, second coupling means for adjustably coupling the second scraping blade to the support whereby the second scraping blade is adjustable relative to the support such that the scraping end of the second scraping blade contacts the inner wall surface of the tubular drum means;

wherein the outer wall surface of the roller means has raised ribs for gripping a can to be crushed, each rib including a first section and a second section with a first gap separating the first and the second sections thereby forming a first track such that the scraping end of the first scraping blade remains adjacent to the outer wall surface of the roller means with the scraping end of of the first scraping blade following in the first track; and wherein the inner wall surface of the tubular drum means has raised ribs for gripping a can to be crushed, each rib including a third section and a fourth section with a second gap separating the third and the fourth sections thereby forming a third track such that the scraping end of the second scraping blade remains adjacent to the inner wall surface of the tubular drum means with the scraping end of the second scraping blade following in the third track.

* * * * *